United States Patent [19]

Boujet

[11] 4,145,673

[45] Mar. 20, 1979

[54] MULTIPLEXER FOR MILLIMETRIC WAVES

[75] Inventor: Jean-Pierre Boujet, Chatillon, France

[73] Assignee: Societe Anonyme dite Compagnie Industrielle des Telecommunications Cit-Alcatel, Paris, France

[21] Appl. No.: 816,954

[22] Filed: Jul. 19, 1977

[51] Int. Cl.[2] ..... H01P 1/20; H01P 5/12

[52] U.S. Cl. ..... 333/135; 333/251

[58] Field of Search ..... 333/6, 9, 98 M

[56] References Cited

U.S. PATENT DOCUMENTS

| | | | |
|---|---|---|---|
| 3,050,701 | 8/1962 | Tang | 333/9 X |
| 3,771,076 | 11/1973 | Kidner et al. | 333/98 M X |
| 3,787,787 | 1/1974 | Shimada et al. | 333/98 M |

*Primary Examiner*—Paul L. Gensler
*Attorney, Agent, or Firm*—Roland Plottel

[57] ABSTRACT

A series connection of n diplexers is used as a multiplexer for separating a hyperfrequency band into n + 1 sub-bands (or vice-versa). Each diplexer comprises a semi-circular inlet coupler followed by a semi-circular high-pass filter and by a semi-circular outlet coupler, the filter at each stage is dimensioned to reflect only the lowest of the sub-bands which it receives from the previous stage. The creation of unwanted parasitic modes in the reflected sub-band is avoided by so choosing the radius of the inlet coupler that the reflected sub-band lies between the frequencies at which the parasitic $TE_{12}$ and $TE_{22}$ modes occur. This is achieved by use of the relationship $$\frac{v}{2\pi}\cdot\frac{1}{f\min}\cdot P'_{12}<R<\frac{v}{2\pi}\cdot\frac{l}{f\max}\cdot P'_{22}$$

where v is the speed of light, fmax and fmin are the upper and lower limit frequencies of the reflected sub-band and $P'_{12}$ and $P'_{22}$ are the second zeros of the first and second order Bessel functions characterising the respective semi-circular $TE_{12}$ and $TE_{22}$ modes.

5 Claims, 3 Drawing Figures

MULTIPLEXER FOR MILLIMETRIC WAVES

The invention is in the field of millimetric wave technology and concerns in particular a multiplexer for separating a hyperfrequency band into n + 1 sub-bands (n being 2, 3, . . .) or vice-versa, the multiplexer comprising n diplexers in series, each diplexer comprising a semi-circular inlet coupler followed by a semi-circular high-pass filter and a semi-circular output coupler, the filter being so dimensioned that it reflects only the lowest one of the sub-bands which the diplexer in question receives.

A millimetric wave diplexer is a device which separates one frequency band into two sub-bands or which combines two sub-bands to form a single-band. Such a diplexer is particularly used in the multiplexing of PCM telephone channels for their transmission by circular wave guides.

It is known that transmission by a circular wave guide makes use of waves in the circular $TE_{01}$ mode. Repeaters are placed at intervals of about 20 km to 30 km along the line for amplification and regeneration of the signals. For this purpose the repeaters are provided with filters which sub-divide the total frequency band for regeneration and which reassemble it after regeneration. A multiplexer is thus a filter with one inlet for the entire band and multiple outlets for the sub-bands. Such a multiplexer may be constituted, as has been described in French patent application No. 73 34 997 (published under the number 2 246 089), by putting several semi-circular diplexers in series. By using transition modules for circular/semi-circular and semi-circular/circular conversion, such a multiplexer based on semi-circular wave guide technology may be integrated into the path of circular wave guides.

It is known that such assemblies are symmetrical i.e. that the same device can be used either for decomposition of the band or for its recomposition. If, hereafter in the present description reference is only made to decomposition, that is only by way of example and for the sake of clarity; it follows automatically that the invention also covers the inverse function. It should be noted here, that whatever direction a diplexer is used in, the term "input coupler" is used hereafter for that one of its two couplers which covers the wider band width.

The above mentioned French patent specification describes the division of one band, for example from 31 to 60 GHz into four sub-bands, namely 31 to 38.15, 39.35, to 46.50, 48 to 53.5 and 54.5 to 60 GHz, by putting three diplexers in series. The first diplexer receives the entire band, on its reflection outlet it delivers the first sub-band and on its other outlet it delivers the three other sub-bands. This set is applied to the second diplexer which, in turn separates the second sub-band and delivers the remaining sub-bands to the third diplexer. Likewise the third diplexer separates the two highest frequency sub-bands.

In order to obtain satisfactory transmission losses over the whole width of the reflected sub-bands, it is necessary to machine the components of the multiplexer to very fine tolerances and to assemble them into a very rigid structure. This leads to high manufacturing and assembly costs.

Preferred embodiments of the present invention reduce these costs while still obtaining satisfactory transmission losses in the reflected sub-bands. This is achieved by a judicious choice of the inlet radii of series-connected diplexers. Their radii are chosen as a function of the sub-bands reflected by the high-pass filters to which the inlet couplers are connected.

The present invention provides a millimetric wave multiplexer suitable for separating a hyperfrequency band into n + 1 sub-bands (n being 2, 3, . . . ) or vice-versa comprising n diplexers in series, each diplexer comprising a semi-circular inlet coupler followed by a semi-circular high-pass filter and by a semi-circular outlet coupler, the filter being dimensioned to reflect only the lowest sub-band which is received by the diplexer in question, wherein the radius R of the inlet coupler of each diplexer and the sub-band reflected by its high-pass filter are chosen in such a manner that:

$$\frac{v}{2\pi}\cdot\frac{1}{f\min}\cdot P_{12}<R<\frac{v}{2\pi}\cdot\frac{l}{f\max}\cdot P'_{22}$$

Where v is the speed of light, fmin and fmax are respectively the lower and the upper limit frequencies of the reflected sub-band and $P'_{12}$ and $P'_{22}$ are the second zeros of the first and second order Bessel functions characterising the respective semi-circular $TE_{12}$ and $TE_{22}$ modes.

This particular choice enables the sub-band which is reflected by the high-pass filter of each diplexer to be fitted in between the frequencies $f_{12}$ and $f_{22}$ at which the respective parasitic semi-circular $TE_{12}$ and $TE_{22}$ modes are created. Thus the frequencies $f_{41}$ and $f_{02}$ at which the respective parasitic semi-circular $TE_{41}$ and $TE_{02}$ modes are created also lie outside the reflected sub-band since the frequencies $f_{41}$, $f_{12}$, $f_{22}$ and $f_{02}$ are always such that $f_{41}<f_{12}<f_{22}<f_{02}$.

Conventionally these four parasitic modes would create large attenuation peaks in the transmission loss curves of the reflected sub-bands at the slightest mechanical misalignment of the various guides. But, by removing these modes completely from the reflected sub-band it is no longer necessary to have an extremely rigid assembly and the multiplexer is insensitive to slight mechanical defects in its components.

In an advantageous embodiment of the invention the radius (in millimeters) of the inlet coupler of at least one diplexer is to be about near to 258/fmin, where the frequency fmin is expressed in GHz and the frequency fmax, is chosen to be near to 1.24 fmin.

Given that the first diplexer which reflects the lowest sub-band must transmit all the other sub-bands, it is important that its couplers cover a very wide range of frequencies. This range is defined by the 3db attenuation points. Now generally the inlet coupler has a response curve which is symmetrical for the reflected band, having a maximum loss at the centre of the range and a rising slope near the two edges of the reflected band. However, in a preferred embodiment of the invention, the response curve of the inlet coupler of the first diplexer has a negative slope throughout the whole of the reflected band, being limited only by the level of standing waves admitted. This enables the range of transmitted frequencies to be extended upwards.

An embodiment of the invention will be described below in greater detail with reference to the accompanying drawings in which.

Figure 1:
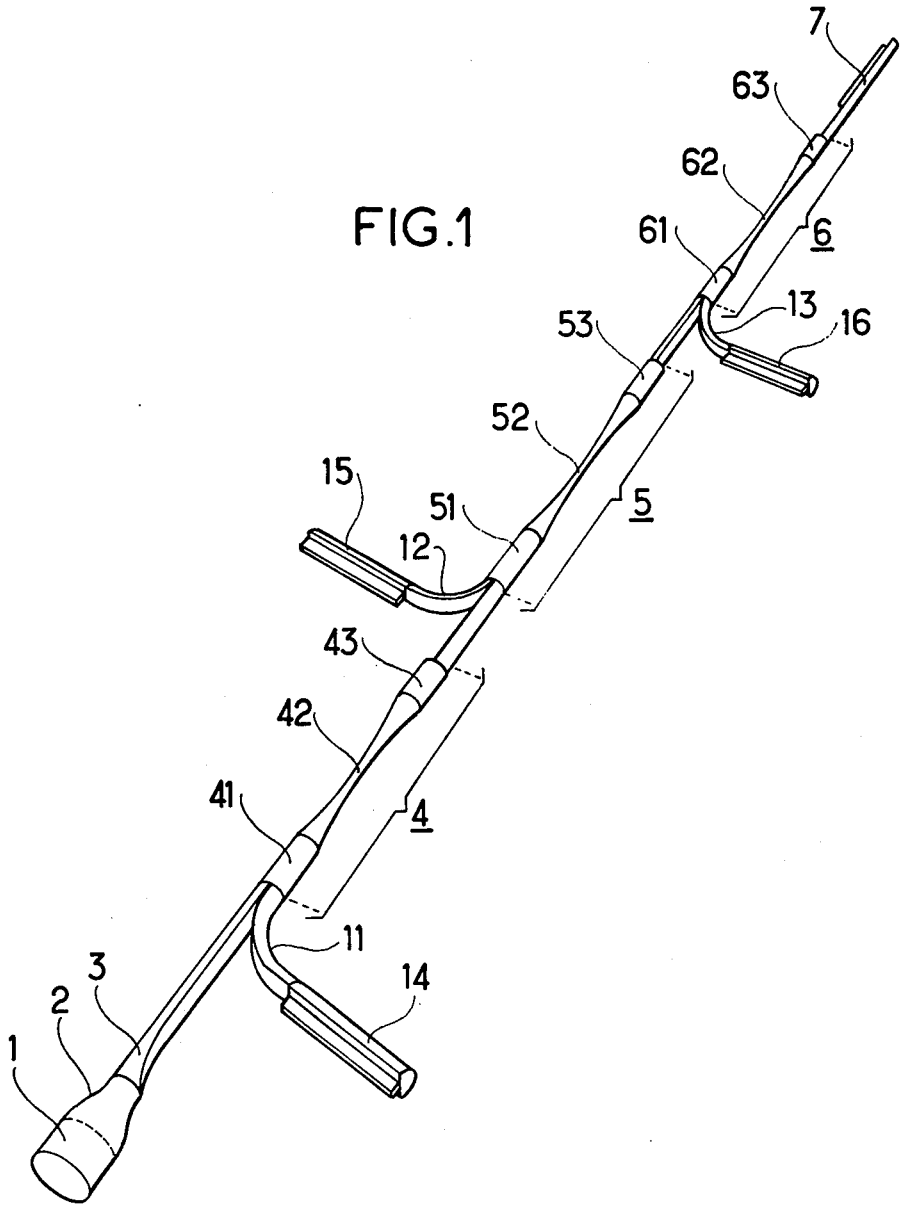
FIG. 1 is a perspective view of a multiplexer embodying the invention.

With reference to FIG. 1 it can be seen that a wave guide 1, having a diameter of 50 mm for example, arrives at the multiplexer. The frequency band goes from 31 to 60 GHz and is decomposed into four sub-bands as mentioned above. The assembly comprises a series connection of:

- a transition 2 operating in circular $TE_{01}$ mode for changing the diameter from 50 mm to 14.28 mm;
- a transition 3 for changing from circular $TE_{01}$ mode to semi-circular $TE_{01}$ mode;
- three semi-circular guide diplexers 4, 5 and 6 connected in cascade; and finally
- a total semi-circular/rectangular coupler 7.

Each diplexer is made as described in the above referenced French patent specification, and it comprises in particular an inlet coupler 41, 51 or 61, followed by a respective high-pass filter 42, 52 or 62 and by a respective outlet coupler 43, 53 or 63. A coupler is constituted by a circular tube whose interior is divided into two semi-circular guides by a metal strip which includes coupling holes. One end of one of the guides of the inlet coupler constitutes the inlet to the diplexer, and it is connected to the outlet of the preceding diplexer or to the circular/semi-circular transition 3 of the assembly as a whole. The other guide of the inlet coupler of each diplexer is connected to a respective angled semi-circular guide 11, 12 or 13 which leads to a respective semi-circular/rectangular total coupler 14, 15 or 16 similar to the coupler 7. The two remaining ends of the inlet couplers 41, 51 and 61 are connected to respective high-pass filters 42, 52 and 62, constituted by a constricted tube of circular section which is divided by a metal strip into two semi-circular wave guides whose radii decrease and then increase.

The respective ends of these filters which are distant from their inlet couplers are connected to respective outlet couplers 43, 53 and 63, similar to the inlet couplers 41, 51, 61. One of the semi-circular guides of these couplers includes an appropriate load and the other constitutes the outlet of the diplexer.

The various diplexers, and in particular the radii of the couplers and of the high-pass filters are dimensioned in such a way that the first diplexer 4 reflects the first sub-band of 31 to 38.15 GHz, that the second diplexer 5 which receives the remaining sub-bands, reflects the second sub-band of 39.35 to 46.5 GHz, and the third diplexer 6 which receives the two remaining sub-bands delivers the third sub-band of 48 to 53.3 GHz to the coupler 16 and the fourth sub-band, i.e. 54.5 to 60 GHz, to the coupler 7.

The radii of the inlet couplers are so chosen that the semi-circular parasitic $TE_{41}$, $TE_{12}$, $TE_{22}$ and $TE_{02}$ modes which are created lie outside the useful band and in particular outside the frequencies reflected at the high-pass filters. If the frequencies of the parasitic modes were in the energy band which is reflected, any off-centredness of the wave guides e.g. from a coupler plate that is not perfectly plane or for any other mechanical fault, would lead to absorption peaks at the frequencies at which the said modes were created. The choice of the radius according to the invention as a function of the reflected band of the diplexer enables response curves to be obtained which are very flat and without perturbations. This is most important for mass production since perfect centering of the components is not absolutely essential.

Stated more precisely, the radius of the inlet coupler of each diplexer is chosen in such a manner that the frequencies $f_{12}$ and $f_{22}$ (i.e. those at which the respective parasitic $TE_{12}$ and $TE_{22}$ are created) are situated on either side of the sub-band reflected by the high-pass filter of the diplexer. And since the frequencies $f_{41}$ and $f_{02}$ (i.e. those at which the respective parasitic $TE_{41}$ and $TE_{02}$ modes are created are situated beyond the frequencies $f_{12}$ and $f_{22}$ ($f_{41}$ being below $f_{12}$ and $f_{02}$ being above $f_{22}$ which is itself above $f_{12}$) it can be seen that this enables the four parasitic modes to be relegated to frequencies which lie outside the reflected sub-band.

The frequencies of the parasitic modes are given by the equation:

$$f_{nm} = \frac{v}{2\pi} \cdot \frac{1}{R} \cdot P'_{nm}$$

Where v is the speed of light, and $P_{nm}$ is the mth zero of the nth order Bessel function that characterises the mode $TE_{nm}$ under consideration, and R is the radius of the inlet coupler. It should be noted here that the term "radius of the coupler" is used to mean the radius of each of the semi-circular wave guides which constitute the coupler increased by half the thickness of the coupling strip which separates the guides. Both semi-circular guides have the same radius.

For the $TE_{12}$ mode, $P'_{12} = 5.3314$ and for the $TE_{22}$ mode, $P'_{22} = 6.7016$. The ratio of these constants (6.706/5.3314) is 1. 257 and it constitutes the maximum ratio which can exist between the upper and lower limit frequencies of the reflected sub-band that is compatible with the existence of some radius R which will reject both the upper and the lower parasitic frequencies $f_{22}$ and $f_{12}$.

It should be noticed that the series connection of the diplexers constituting the multiplexer has the advantage that the reflected sub-bands are relatively narrow and, because of this, there always exists an ideal radius for the inlet coupler of each diplexer which avoids the creation of parasitic modes in the sub-band reflected by the high-pass filter of the diplexer.

Let us take the decomposition of the total band from 31 to 60 GHz as an example with reflection of the first sub-band from 31 to 38.15 GHz. For a first diplexer having a semi-circular inlet coupler of radius $R = 8.32$ mm, the following semi-circular parasitic modes are created: $TE_{41}$ (at 30.49 GHz), $TE_{12}$ (at 30.57 GHz), $TE_{22}$ (at 38.46 GHz) and $TE_{02}$ (at 40.23 GHz), which are all outside the reflected sub-band. Likewise for a second diplexer which receives a band from 39.35 to 60 GHz and whose reflected sub-bands extends from 39.35 to 46.5 GHz, and with a radius $R = 6.8$ mm the following parasitic modes are created: 37.31 GHz (for $TE_{41}$), 37.40 GHz (for $TE_{12}$), 47.05 GHz (for $TE_{22}$) and 49.23 GHz (for $TE_{02}$). These parasitic modes are likewise outside the reflected sub-band.

It is easy to see that the same is true for a third diplexer which receives a band extending from 48 to 69 GHz and whose reflected sub-band extends from 48 to 53.3 GHz, the radius R of the diplexer being 5.8 mm.

Advantageously, the angled semi-circular guides 11,12 and 13 have the same radii as their corresponding semi-circular guides, and because of this they may be of a smooth structure. The ohmic attenuation is identical to that of a straight length of semi-circular guide of the same length and of the same radius and its response is parasite-free.

The choice of the radii for the semi-circular couplers of the diplexers according to the invention enables parasitic mode creation to be avoided in the couplers, angles, etc., and thus avoids the use of filters for removing the parasitic modes. A moderate manufacturing price can thus be obtained and the response curves are without peaks, which makes the multiplexer of the invention applicable to very wide bands.

Further, the radius of the outlet coupler 43 of the first diplexer 4 is advantageously chosen to be equal to the radius of the inlet coupler 51 of the second diplexer 5. The same is true for the outlet coupler 53 of the second diplexer 5 and the inlet coupler 61 of the third diplexer 6. These choices are particularly helpful in that they facilitate the physical structure of the multiplexer by eliminating the need for radius-changing transitions. The radius of the outlet coupler 63 of the last diplexer is less than the radius of its inlet coupler 61; by way of comparison in the numerical example given below, the radius of the coupler 63 would be 5.22 mm.

Figure 2:
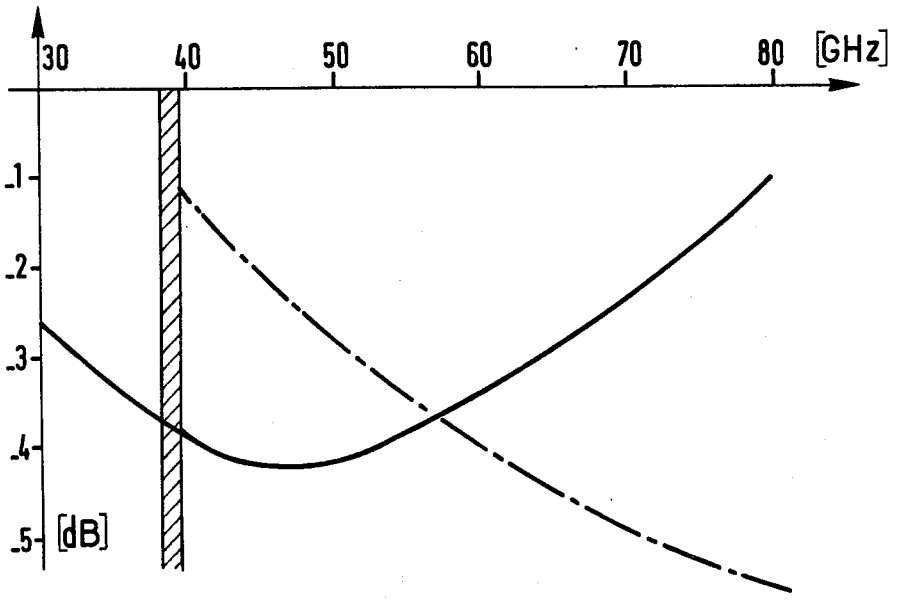
FIG. 2 shows the response curves of the first diplexer in the multiplexer of FIG. 1.

FIG. 2 shows the attenuation curves as a function of frequency for the couplers 41 and 43 of the first diplexer 4 for the case of a total band which stretches as far as 80 GHz. The continuous curve relates to the inlet coupler 41. This curve drops throughout the reflected sub-band which goes from 31 to 38.15 GHz and the curve rises slowly thereafter as far as 80 GHz.

In the 31 to 38.15 GHz reflected sub-band the choice of gradient (negative) for this curve is limited only by the standing wave ratio which can be tolerated in the sub-band. For example, if a standing wave ratio of 1.25 is allowed in the 31 to 38.15 GHz sub-band, the coupling will vary from −2.7 dB at 31 GHz, to 3.7 dB at 38.15 GHz. Such a coupling response can be obtained with a relatively compact inlet coupler, which is about 350 mm long.

The peaked curve relates to the outlet coupler 43. This curve falls throughout the entire transmitted band, i.e. from 39.35 to 80 GHz and its slope is chosen as an approximate compensation for the rising curve of the first coupler. The overall response of the diplexer is thus practically constant between 39.35 and 80 GHz. This choice of the curves of the two couplers of the first diplexer thus enables the useful band to be enlarged up to a band width which is greater than 100% of the central frequency if the band considered. This is impossible if the inlet coupler possesses a symmetrical response in the reflected band.

The design of a coupler which satisfies a given coupling curve is a conventional operation for the man of the art; it will suffice here to recall that such a design is performed by choosing: the thickness of the coupling strip common to both the wave guides of the coupler; the number of coupling holes; their diameter; and their position relative to the axis of the coupler.

Figure 3:
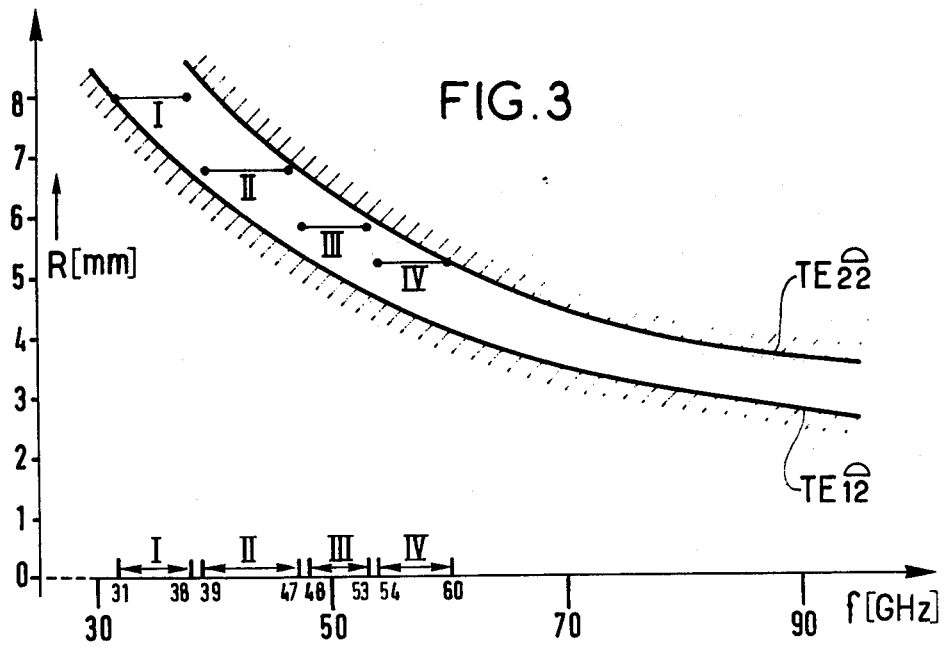
FIG. 3 is a diagram for simplifying the choice of radii.

Finally, FIG. 3 shows a diagram in which the abscissa represents the frequency and the ordinate the radius of the inlet coupler. In this diagram there are two hyperbolic curves, $$f = \frac{v}{2\pi} \cdot \frac{1}{R} \cdot P'_{12} \text{ and } f = \frac{v}{2\pi} \cdot \frac{1}{R} \cdot P'_{22}$$

respectively, of which the lower curve constitutes the curve for creation of the parasitic semi-circular $TE_{12}$ mode, and the upper curve constitutes the curve of the creation of the parasitic semi-circular $TE_{22}$ mode. By situating the reflected sub-bands I, II, III and IV according to the distribution mentioned above, it can be seen that the radius R of the inlet coupler must be so chosen that the horizontal line representing the band in question touches neither the upper nor the lower curve; i.e. with f min and f max respectively representing the lower and upper limits of the reflected sub-band, R should be so chosen that:

$$\frac{v}{2\pi} \cdot \frac{1}{f\min} \cdot P'_{12} < R < \frac{v}{2\pi} \cdot \frac{l}{f\max} \cdot P'_{22}$$

the sub-band reflected by its high-pass filter are chosen in such a manner that:

$$\frac{v}{2\pi} \cdot \frac{1}{f\min} \cdot P'_{12} < R < \frac{v}{2\pi} \cdot \frac{l}{f\max} \cdot P'_{22}$$

where v is the speed of light, f min and f max are respectively the lower and the upper limit frequencies of the reflected sub-band and $P'_{12}$ and $P'_{22}$ are the second zeros of the first and second order Bessel functions characterising the respective semi-circular $TE_{12}$ and $TE_{22}$ modes.

With reference to FIG. 3, it can be seen that the distribution of the four sub-bands such as mentioned above, is only an example of a possible frequency plan, which could be easily adapted to couplers and filters at higher frequencies. For example, looking at FIG. 2, it would be possible to device a system having three diplexers, i.e. four sub-bands which lie between 31 and 38.15, between 39.35 and 46.50, between 48 and 60 and between 61 and 75 GHz. The radii of the inlet couplers of such a system are successively 8.32 mm, 6.8 mm and 5.3 mm.

In general the sub-bands chosen and the corresponding values of the radii R of the inlet couplers must satisfy equation (1) above. The width which can be given to a reflected sub-band increases as the value of R approaches, as close as possible, the lower limit $$\frac{v}{2\pi} \cdot \frac{1}{f\min} \cdot P'_{12}$$

i.e. 254.4/f min where f min in GHz gives R in mm. In practice, however, R is preferably chosen to be slightly larger than this theoretical minimum. For example, R (in mm) is advantageously chosen to be about 258/f min, (f min in GHz) for which the sub-band's upper limit frequency, f max is about 1.24 f min.

What we claim is:

1. A millimetric wave multiplexer for separating a hyperfrequency band into n + 1 sub-bands (n being 2, 3, . . .) or vice versa, comprising n diplexers in series, each diplexer comprising a semi-circular inlet coupler followed by a semi-circular high-pass filter and a semi-circular output coupler, the filter being dimensioned to reflect only the lowest sub-band which is received by the diplexer in question, wherein the radius R of the inlet coupler of each diplexer and the sub-band reflected by its high-pass filter are chosen in such a manner that:

$$\frac{v}{2\pi} \cdot \frac{1}{f\min} \cdot P'_{12} < R < \frac{v}{2\pi} \cdot \frac{l}{f\max} \cdot P'_{22}$$

where v is the speed of light, f min and f max are respectively the lower and the upper limit frequencies of the reflected sub-band and $P'_{12}$ and $P'_{22}$ are the second zeros of the first and second order Bessel functions characterising the respective semi-circular $TE_{12}$ and $TE_{22}$ modes.

2. A multiplexer according to claim 1 wherein the radius (in mm) of the inlet coupler of at least one diplexer is chosen to be about 258/f min, where f min is the lower limit frequency (in GHz) of the reflected sub-band, and in that the frequency f max is chosen to be about 1.24 f min.

3. A multiplexer according to claim 1 wherein the reflected sub-bands are extracted by angled semi-circular wave guides of smooth structure without parasitic mode filters, the radii of these angled wave guides being determined as for the corresponding inlet couplers.

4. A multiplexer according to claim 1, wherein the inlet coupler of at least the diplexer covering the widest band has a transfer characteristic of negative slope throughout the reflected band, said slope being limited only by the standing wave ratio which can be tolerated in the reflected band.

5. A multiplexer according to claim 1 wherein each interconnection between a pair of successive diplexers is provided by an outlet coupler and an inlet coupler both having the same radius.

* * * * *